US008096495B2

(12) United States Patent
Billman

(10) Patent No.: US 8,096,495 B2
(45) Date of Patent: Jan. 17, 2012

(54) SPINDLE FOR A ROLL OF WEB MATERIAL

(75) Inventor: Craig Billman, Phoenixville, PA (US)

(73) Assignee: SCA Tissue North America LLC, Philadelphia, PA (US)

( * ) Notice: Subject to any disclaimer, the term of this patent is extended or adjusted under 35 U.S.C. 154(b) by 0 days.

(21) Appl. No.: 12/358,485

(22) Filed: Jan. 23, 2009

(65) Prior Publication Data

US 2010/0187351 A1 Jul. 29, 2010

(51) Int. Cl.
*B65H 75/18* (2006.01)

(52) U.S. Cl. ..... 242/599.4; 242/598.3

(58) Field of Classification Search ..... 242/598, 242/598.3, 598.4, 599.3, 599.4, 599
See application file for complete search history.

(56) References Cited

U.S. PATENT DOCUMENTS

| | | | | | |
|---|---|---|---|---|---|
| 1,234,223 | A * | 7/1917 | Searing | 242/599.3 |
| 1,234,746 | A * | 7/1917 | Fish | 242/599.4 |
| 2,902,233 | A * | 9/1959 | McDonough | 242/598.3 |
| 3,258,216 | A * | 6/1966 | Wren | 242/599.4 |
| 3,318,543 | A * | 5/1967 | Moore | 242/599.4 |
| 5,402,978 | A | 4/1995 | Larson | |
| 5,467,935 | A * | 11/1995 | Moody | 242/599.1 |
| 5,495,997 | A * | 3/1996 | Moody | 242/599.3 |
| 6,199,791 | B1 | 3/2001 | Conran et al. | |
| 6,367,734 | B1 * | 4/2002 | Cartwright | 242/598.3 |
| 6,439,501 | B1 * | 8/2002 | Harmathy | 242/599.4 |
| 2007/0210206 | A1 | 9/2007 | Nip | |

* cited by examiner

*Primary Examiner* — William A Rivera
(74) *Attorney, Agent, or Firm* — Young & Thompson

(57) ABSTRACT

A spindle includes two end portions, spaced apart from one another, with the two ends being of substantially equal diameters. The two ends are configured to interact with a support structure that is designed to hold a roll of web material. The spindle also includes a widened portion located between the two end portions. At a portion spaced from the widened portion, the spindle is configured to receive a removable member.

8 Claims, 3 Drawing Sheets

SPINDLE FOR A ROLL OF WEB MATERIAL

FIELD OF THE INVENTION

This invention relates to a spindle for a roll of web material.

BACKGROUND OF THE INVENTION

Web material such as toilet tissue or paper towels may come in various forms. The invention as described below is intended for use with a roll of web material having a core.

The type of web material wound about the core is not limited, however, and the mentioned toilet tissue is meant as a non-limiting example. With this in mind, some toilet tissue is manufactured with a plug in one end of a central core. Such toilet tissue with a plug in one end creates a core with openings of different diameters on each end. This type of toilet tissue would then require the removal of the plug (if possible) or it would not work with a conventional symmetrical toilet tissue spindle, because: 1) either the spindle is too large to fit through the smaller diameter opening at the plug end of the core, or 2) the spindle is narrow enough to fit through the smaller diameter opening, but then does not support the core at the end with the larger opening, causing the roll of tissue to tip to one side, or sit askew in its dispenser, and thus it will not properly dispense paper.

What is needed is a spindle that can be used with various sized openings.

SUMMARY OF THE INVENTION

This need is met at least in part by a spindle as described herein. One embodiment of a toilet tissue spindle includes two end portions, spaced apart from one another, with the two ends being of substantially equal diameters. The two ends are configured to interact with a support structure that is designed to hold a roll of web material. The spindle also includes a widened portion located between the two end portions. In one embodiment, the widened portion is bilaterally non-symmetrical about a plane perpendicular to the axis of the spindle. In another embodiment, the widened portion has at least first and second portions having different diameters.

BRIEF DESCRIPTION OF THE DRAWINGS

Other features and advantages of the invention will be described below in conjunction with the following drawing figures, in which.

DETAILED DESCRIPTION OF THE INVENTION

Figure 1:
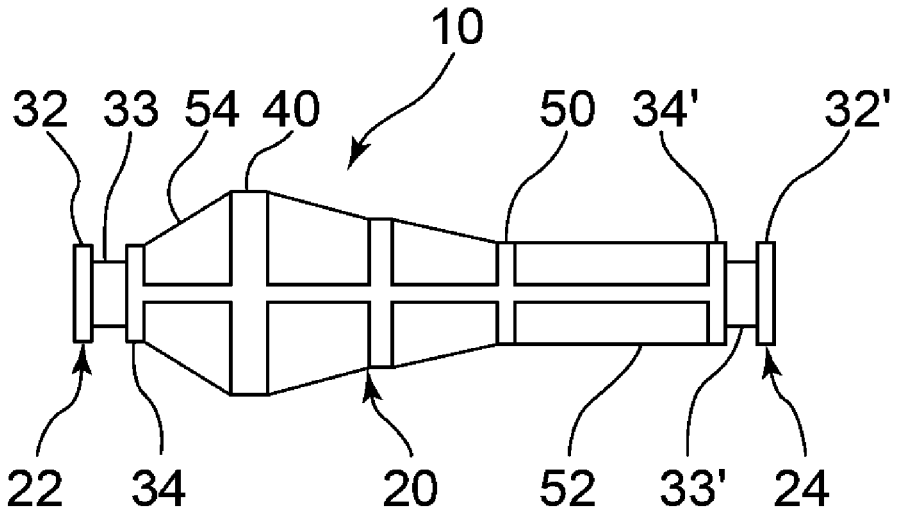
FIG. 1 is a side view of a spindle of a first embodiment of the invention.

FIG. 1 shows a spindle 10. The spindle includes an elongate body 20 having a first end 22 and a second end 24. The first end 22 includes a first flange 32 and a second flange 34. The first and second flanges 32, 34 define therebetween an area of reduced cross-section 33 that is intended to rest on and rotate relative to a support structure (not shown) such as a wall mounted bracket, a recessed bracket or a bracket or a pair of support arms within a dispenser housing. The type of support structure is not intended to be limited to those mentioned herein and any support structure known in the art that is capable of rotatably supporting a roll of web material in preferably a horizontal position is contemplated by the present invention.

The second end 24 also has a first flange 32' and a second flange 34' with an area of reduced cross-section 33' therebetween that is intended to rest on the support structure. The flanges 32, 34 and 32', 34' of FIG. 1 are identical. However, different flange structure on each end, or a flange on one end and a different structure that enables the end of the spindle to rest on and/or rotate with respect to the support structure are contemplated by the invention.

The spindle 10 also includes a first portion 40 having a cross-section in a plane perpendicular to a rotational axis greater than that of all other portions of the spindle. That is, a maximum radial extent for a non-circular first portion or a maximum diameter for a circular first portion. In one embodiment, as illustrated by way of example in FIG. 1, the first portion 40 is nearer to the first end 22. However, the first portion 40 can be anywhere between the first end 22 and the second end 24. In a presently preferred embodiment, the first portion 40 is appropriately sized so as to securely fit by, for example, an interference fit within a core of a roll of web material (see FIG. 3). Spaced from the first portion 40 and, in as seen in FIG. 1, closer to the second end 24 is a second portion 50 having a cross-section in the plane perpendicular to the rotational axis smaller than the first portion and configured to receive a removable member 70 thereon (see FIGS. 3 and 4).

In FIG. 1, the elongate body 20 gradually decreases from the first portion 40 to the second portion 50. As also seen in FIG. 1, the second portion 50 includes an elongate section 52 having a substantially constant cross-section in the plane perpendicular to the rotational axis. However, such elongate portion 52 is not required and the elongate body may decrease from the first portion 40 to the second portion 50, wherein the second portion is at or immediately adjacent to the second flange 34' of the second end 24, similar to the section 54 extending from the first portion 40 to the second flange 34 at the first end 22.

Figure 2:
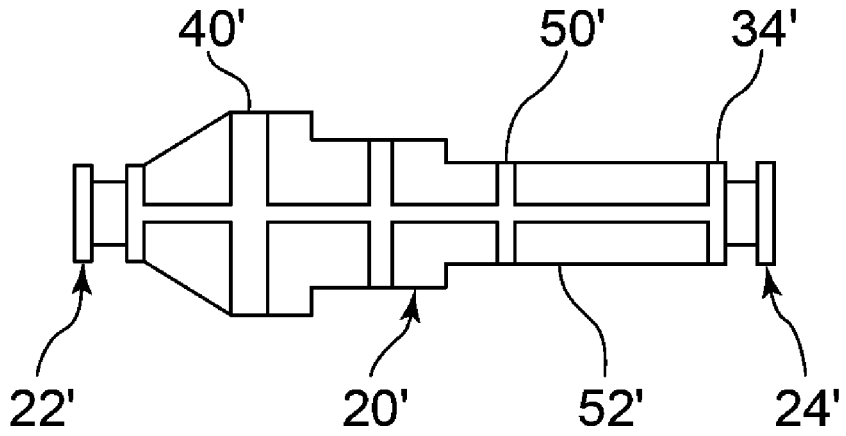
FIG. 2 is a side view of a spindle of a second embodiment of the invention.

Alternatively, as seen in FIG. 2, the cross-section in the plane perpendicular to the rotational axis of the elongate body 20' decreases by steps from a first portion 40' to a second portion 50'. Similar to FIG. 1, the steps may end at an elongate section 52', or the steps may end at or adjacent to the second flange 34' at the second end 24'.

The spindle 10 may be a one-piece construction that is formed as a single piece by injection molding or other molding procedure. Alternatively, the spindle 10 may be formed as a multiple piece assembly that is connected together. The spindle may be made from a rigid material or a compressible material.

Figure 3:
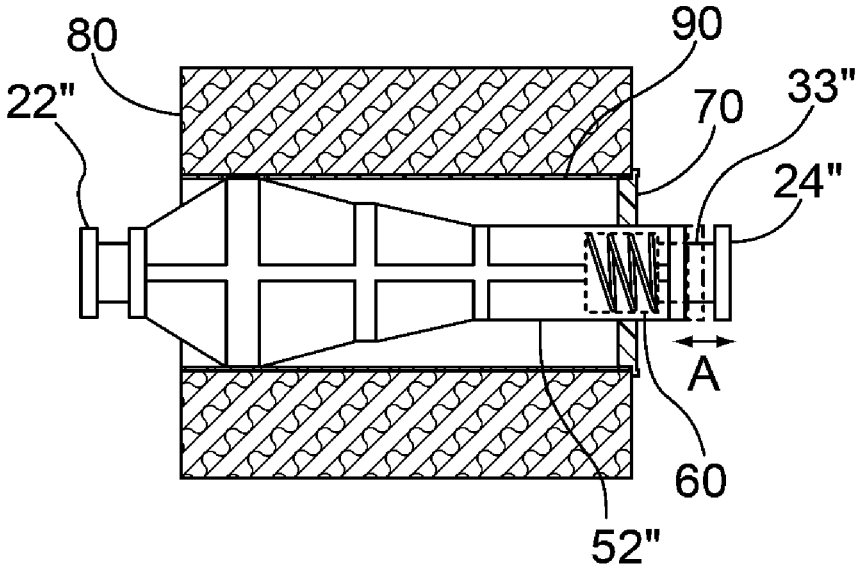
FIG. 3 is a side view of a third embodiment including additional elements that interact with the spindle.
Figure 4:
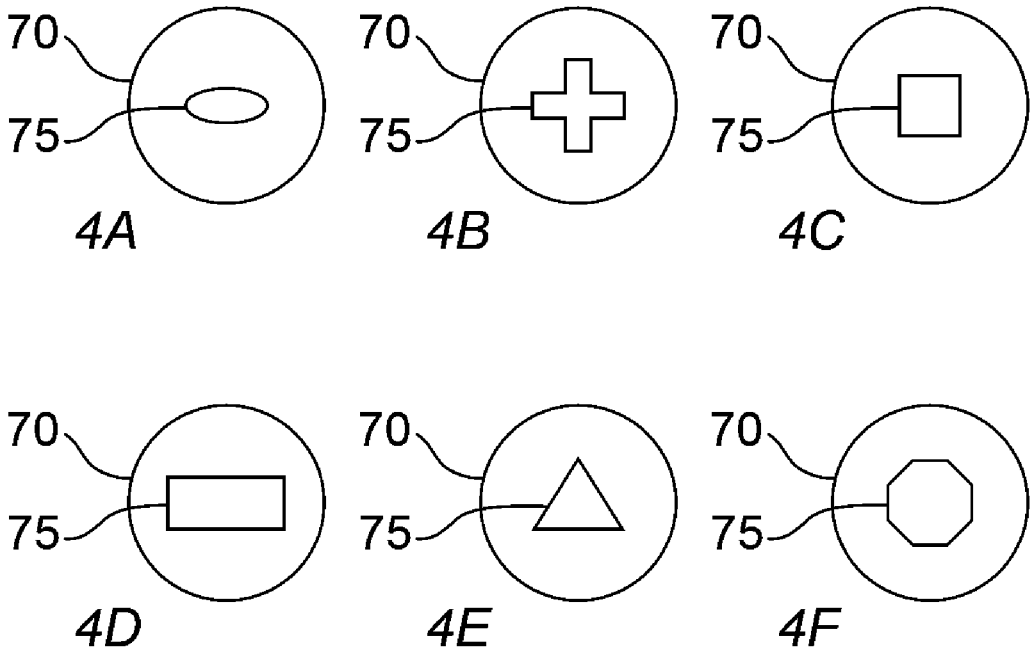
FIGS. 4A-4F are top views of a removable member according to the invention.

FIG. 3 shows the spindle 10 configured to be movable in the axial direction denoted "A" along a rotation axis of the spindle 10 so that an axial length of the spindle 10 is variable. Such axial movement may be effected by the area of reduced cross-section 33" sliding within the elongate portion 52" as indicated in phantom.

FIG. 3 shows a spring as a biasing member 60 near the second end 24". However, any type of biasing member 60 that might be configured to urge or push the spindle or at least part of the spindle in an axial direction is contemplated by the present invention. The biasing member 60 may be within the spindle 10 at the second end 24" or at the first end 22" or both the first and second ends 22", 24" so that the spindle is axially compressible to reduce the length of the spindle 10 for removal of the spindle 10 from the mounting structure (not shown).

In a presently preferred embodiment, as seen by way of example in FIG. 3, discussed above, the material of the spindle is preferably a rigid material. Alternatively, the biasing characteristic may be achieved by the spindle 10 itself being made of a compressible or resilient material that returns to its original shape after compression.

In a presently preferred embodiment, the spindle 10 is intended to be used with a removable member 70. The removable member 70 may already be installed in the roll of web material 80 or may be fitted into the second end 24, 24', 24" of the spindle 10 as part of the procedure for inserting the spindle 10 into the roll of web material 80. The removable member 70 may have a circular cross-section in the plane perpendicular to the rotational axis. However, the removable member may have any cross-section in the plane perpendicular to the rotational axis so long as the removable member will fit tightly inside the central core 90, including a circular cross-section with teeth or other projections that maintain the removable member securely within the central core 90. A presently preferred example of a removable member is described in U.S. application Ser. No. 11/541,666, which is incorporated by reference herein.

In order for the removable member 70 to fit securely on the spindle 10, the presently preferred opening 75 in the removable member 70 is non-circular with a mating non-circular elongate section 52 of the spindle 10. However, a circular opening is not excluded from the present invention so long as such opening makes an interference fit or other type of fit that does not permit slippage of the spindle 10 with respect to the removable member 70.

Non-limiting examples of a non-circular opening 75 include an oval opening as seen, by way of example, in FIG. 4A; a plus sign or other cross-shaped opening as seen, by way of example in FIG. 4B; a square opening as seen, by way of example, in FIG. 4C; a rectangular opening as seen, by way of example, in FIG. 4D; a triangular opening as seen, by way of example, in FIG. 4E; and a polygonal opening with more than four sides as seen, by way of example, in FIG. 4F.

Figure 5:
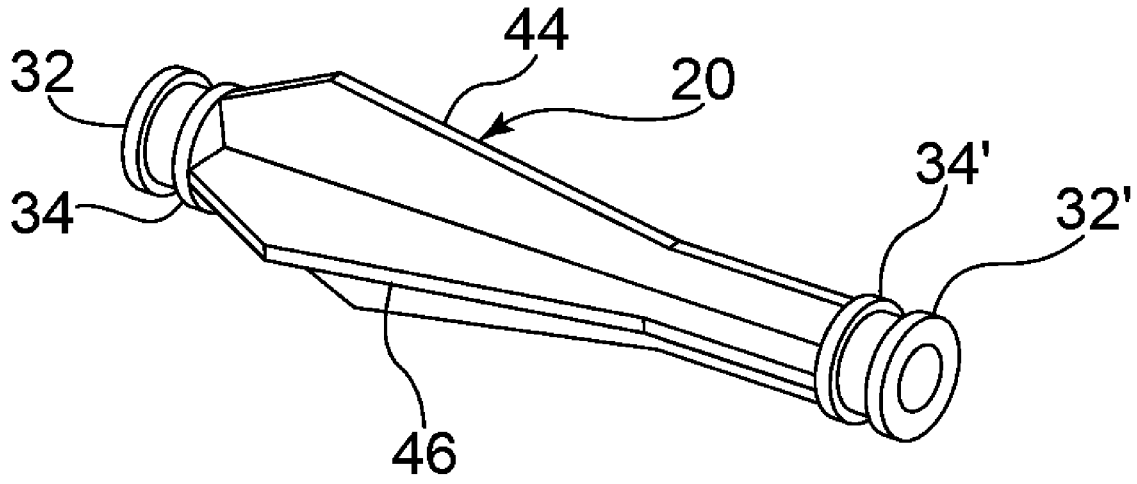
FIG. 5 is a perspective view of a fourth embodiment of the invention including a removable member.

A non-limiting example of a non-circular elongate section is seen in FIG. 5, wherein the spindle body 20 other than the flanges 32, 34 and 32', 34' is formed by two sloped portions 44, 46 that intersect at right angles to form a cross-shaped cross-section in the plane perpendicular to the rotational axis. Of course, the elongate section might have a square, rectangular, triangular or other polygonal shaped cross-section that mates with any of the openings of FIGS. 4A-4F.

While the above disclosure illustrates embodiments of the invention, one of ordinary skill in the art would readily understand that modifications and changes to the invention should be apparent, and that these modifications and changes are intended to be within the spirit and scope of the invention as recited in the appended claims.

I claim:

1. Supporting structure for a roll of web material, said supporting structure comprising:

a spindle including an elongate body having a rotational axis, said spindle having first and second ends that are configured to rotate about said rotational axis relative to a mounting structure that holds said first and second ends in use, said elongate body including a first portion between said first end and said second end, said first portion having a cross-section in a plane perpendicular to said rotational axis with a radial extent greater than that of all other portions of said elongate body, and a second portion spaced from said first portion; and a removable member having an opening, said removable member being detachably mounted on said second portion of said elongate body through said opening, said removable member having a cross-section in a plane perpendicular to said rotational axis with a radial extent substantially the same as said first portion of said elongate body.

2. The supporting structure as claimed in claim 1, wherein the opening is non-circular.

3. The supporting structure as claimed in claim 2, wherein the opening is one of square, oval, rectangular, triangular, or in the shape of a plus sign.

4. The supporting structure as claimed in claim 1, wherein the spindle is a rigid one-piece construction.

5. The supporting structure as claimed in claim 1, wherein the spindle is a rigid multi-piece construction.

6. The supporting structure as claimed in claim 1, wherein the spindle is configured to be axial movable along said rotational axis so that a length of said spindle is variable.

7. The supporting structure as claimed in claim 6, further comprising a biasing member within said spindle that is axially compressible to reduce the length of the spindle for removal from the mounting structure.

8. The supporting structure as claimed in claim 1, wherein the first portion is closer to the first end and the second portion is closer to the second end.

* * * * *